US007292190B2

(12) United States Patent
Teng et al.

(10) Patent No.: US 7,292,190 B2
(45) Date of Patent: Nov. 6, 2007

(54) UWB PRINTED ANTENNA

(75) Inventors: Jia-Lin Teng, Tu-Cheng (TW); Chia-Hao Mei, Tu-Cheng (TW)

(73) Assignee: Hon Hai Precision Industry Co., Ltd., Tu-Cheng, Taipei Hsien (TW)

( * ) Notice: Subject to any disclaimer, the term of this patent is extended or adjusted under 35 U.S.C. 154(b) by 28 days.

(21) Appl. No.: 11/321,163

(22) Filed: Dec. 29, 2005

(65) Prior Publication Data

US 2006/0145929 A1 Jul. 6, 2006

(30) Foreign Application Priority Data

Jan. 6, 2005 (CN) ..... 2005 2 0053547

(51) Int. Cl.
*H01Q 1/38* (2006.01)

(52) U.S. Cl. ..... 343/700 MS; 343/850

(58) Field of Classification Search ..... 343/700 MS, 343/850, 853, 820

See application file for complete search history.

(56) References Cited

U.S. PATENT DOCUMENTS 6,914,573 B1 7/2005 McCorkle 7,064,713 B2 * 6/2006 Koenig ..... 343/700 MS 2005/0088344 A1 * 4/2005 Saitou et al. ..... 343/700 MS

* cited by examiner

*Primary Examiner*—Hoang V. Nguyen

(74) *Attorney, Agent, or Firm*—Morris Manning Martin LLP; Tim Tingkang Xia, Esq.

(57) ABSTRACT

A UWB printed antenna (1) printed on a substrate (10) includes a body (100*a*) for radiating and receiving electromagnetic signals, a signal feeding part (400) for inputting electromagnetic signals to or outputting electromagnetic signals from the body (100*a*), a first feeding part (200), a second feeding part (300), and a third feeding part (500). The first, second and third feeding parts are electronically connected to the signal feeding part for feeding electromagnetic signals to the body. A first body part (201), a first feeding end (202) and a second feeding end (203) of the first feeding part collectively form an "F" shape. A second body part (301), a third feeding end (302) and a fourth feeding end (303) of the second feeding part collectively form an inverted "F" shape. The third feeding part, a first radiating end (101*a*) and a second radiating end (102*a*) collectively form an "H" shape.

16 Claims, 19 Drawing Sheets

Horizontal Polarization

Vertical Polarization

Horizontal Polarization

Vertical Polarization

Horizontal Polarization

Vertical Polarization

Horizontal Polarization

Vertical Polarization

Horizontal Polarization

Vertical Polarization

Horizontal Polarization

Vertical Polarization

Horizontal Polarization

UWB PRINTED ANTENNA

BACKGROUND OF THE INVENTION

1. Field of the Invention

The present invention pertains to antennas, and particularly to a UWB printed antenna disposed on a substrate of a wireless communication device.

2. Related Art

Currently, the main stream of wireless communication is made up of two major groups, the IEEE 802.11 wireless network and the Bluetooth network. The IEEE 802.11 wireless network is now utilized for home application although it was, in the past, exclusively used for commercial purposes only. The IEEE 802.11 wireless network has gradually become the network of choice for portable computers. The Ultra Wide Band (UWB) is the newest wireless communication technology. UWB is a short distance, ultra high speed, and low energy technology. When UWB is technically compared with the IEEE 802.11 wireless network, UWB has an edge over the IEEE 802.11 wireless network because of UWB's high transmission speed and excellent low power consumption.

A UWB antenna must satisfy the input impedance of UWB communications, and must have the ability to control the radiation pattern within a specific bandwidth range. However, UWB antennas that satisfy these two criteria are rare within the technology market. There is demand for a UWB antenna which possesses both wideband operation and omni-directional field pattern characteristics.

Therefore, a heretofore unaddressed need exists in the industry to overcome the aforementioned deficiencies and inadequacies.

SUMMARY

A UWB printed antenna printed on a substrate comprises a body, a first feeding part, a second feeding part, a third feeding part, and a signal feeding part.

The body comprises a first radiating end and a second radiating end, for radiating and receiving electromagnetic signals. A shape of the first radiating end is a trapezium with a right angle and an inverted "L" gap. And the shape of the second radiating end is a trapezium with a right angle and an "L" gap. The first feeding part, for feeding the electromagnetic signals to the first radiating end, comprises a first part, a first feeding end, and a second feeding end. The first feeding end and the second feeding end are electronically connected to the first part and the first radiating end. The first feeding end is electronically connected to a downside of the inverted "L" gap. The second feeding end is electronically connected to an upside of the inverted "L" gap. The first part, the first feeding end, and the second feeing end, collectively form an "F" shape. The second feeding part, for feeding the electromagnetic signals to the second radiating end, comprises a second part, a third feeding end, and a fourth feeding end. The third feeding end and the fourth feeding end are electronically connected to the second part and the second radiating end. The third feeding end is electronically connected to a downside of the "L" gap. The fourth feeding end is electronically connected to an upside of the "L" gap. The second part, the third feeding end, and the fourth feeding end collectively form an inverted "F" shape. The signal feeding part, for inputting or outputting the electromagnetic signals to or from the body, comprises a third part, a first input end, and a second input end. The first input end is electronically connected to the first part and the third part. The second input end is electronically connected to the second part and the third part. And the third part is also the impedance of the body for minimizing the antenna size. The third feeding part is electronically connected to the first radiating end and the second radiating end, for feeding the electromagnetic signals to the first radiating end and the second radiating end. The third feeding part, the first and second radiating ends commonly form an "H" shape.

Other advantages and novel features will be drawn from the following detailed description of preferred embodiments with the attached drawings, in which:

DETAILED DESCRIPTION OF THE EMBODIMENTS

Figure 1:
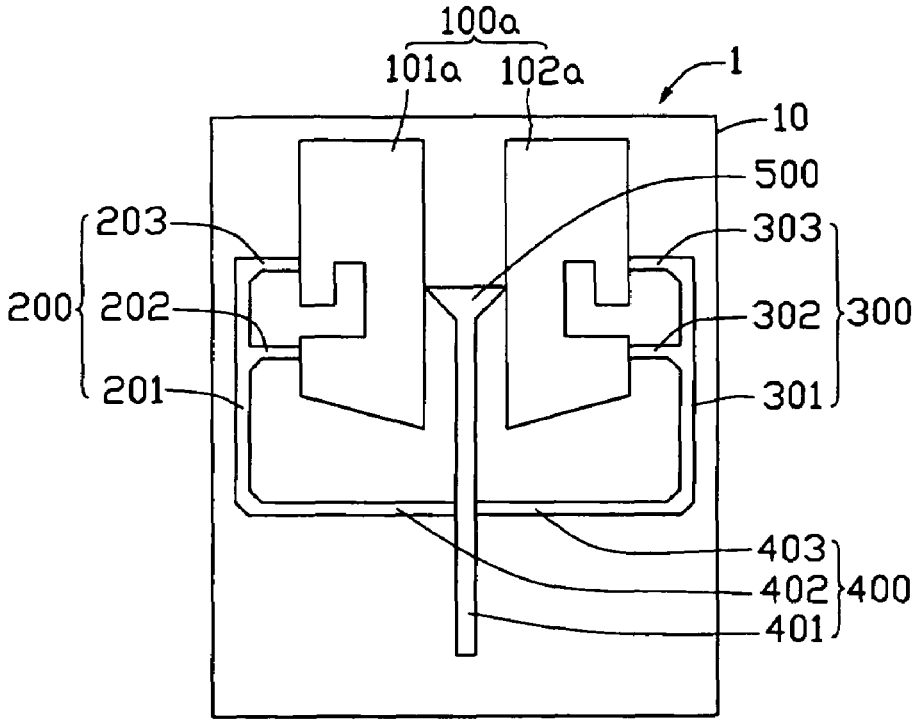
FIG. 1 is a top plan view of a UWB printed antenna in accordance with a first preferred embodiment of the present invention.

FIG. 1 is a top plan view of a UWB printed antenna 1 in accordance with a first preferred embodiment of the present invention. The UWB printed antenna 1 is printed on a substrate 10, and comprises a body 100*a*, a first feeding part 200, a second feeding part 300, a third feeding part 500, and a signal feeding part 400.

The body 100*a* comprises a first radiating end 101*a* and a second radiating end 102*a* for radiating and receiving electromagnetic signals. Each of the radiating ends 101*a* and 102*a* is trapezium-shaped, with the trapezium having two right angles. Each of the radiating ends 101*a* and 102*a* has a generally "L" shaped gap therein. The radiating ends 101*a* and 102*a* are oriented symmetrically opposite each other.

In this embodiment, the first feeding part 200 is for feeding electromagnetic signals to the first radiating end 101*a*, and comprises a first body part 201, a first feeding end 202, and a second feeding end 203. The first feeding end 202 and the second feeding end 203 are electronically connected to the first body part 201 and the first radiating end 101*a*. The first feeding end 202 is electronically connected to the first radiating end 101*a* adjacent one side of the inverted "L" shaped gap. The second feeding end 203 is electronically connected to the first radiating end 101*a* adjacent another side of the inverted "L" gap. The first body part 201, the first feeding end 202 and the second feeing end 203 collectively form an "F" shape.

In this embodiment, the second feeding part 300 is for feeding electromagnetic signals to the second radiating end 102*a*, and comprises a second body part 301, a third feeding end 302, and a fourth feeding end 303. The third feeding end 302 and the fourth feeding end 303 are electronically connected to the second body part 301 and the second radiating end 102*a*. The third feeding end 302 is electronically connected to the second radiating end 102*a* adjacent one side of the "L" shaped gap. The fourth feeding end 303 is electronically connected to the second radiating end 102*a* adjacent another side of the "L" shaped gap. The second body part 301, the third feeding end 302 and the fourth feeding end 303 collectively form an inverted "F" shape.

In this embodiment, the signal feeding part 400 is for inputting electromagnetic signals to or outputting electromagnetic signals from the body 100*a*, and comprises a third body part 401, a first input end 402 and a second input end 403. The first input end 402 is electronically connected to the first body part 201 and the third body part 401. The second input end 403 is electronically connected to the second body part 301 and the third body part 401. The third body part 401 electrically connects with a processing unit like a microprocessor disposed on the PCB and also acts as the impedance of the body 100*a*, in order to minimize the size of the antenna.

In this embodiment, the third feeding part 500 is electronically connected to the first radiating end 101*a* and the second radiating end 102*a*, for feeding the electromagnetic signals to the first radiating end 101*a* and the second radiating end 102*a*. The third feeding part 500, the first radiating end 101*a* and the second radiating end 102*a* commonly form an "H" shape.

Figure 2:
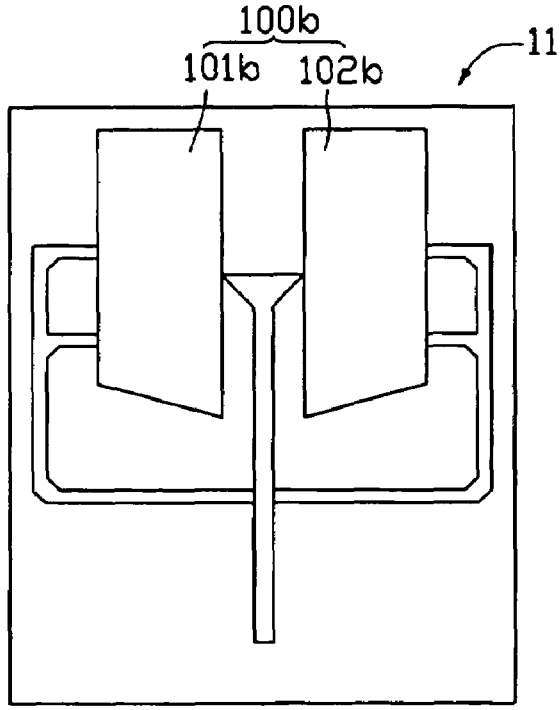
FIG. 2 is a top plan view of a UWB printed antenna in accordance with a second preferred embodiment of the present invention.

FIG. 2 is a top plan view of a UWB printed antenna 11 in accordance with a second preferred embodiment of the present invention. In the second embodiment, a body 100*b* includes a first radiating end 101*b* and a second radiating end 102*b*. Each of the radiating ends 101*b* and 102*b* is trapezium-shaped, with the trapezium having two right angles. The radiating ends 101*b* and 102*b* are oriented symmetrically opposite each other. Other elements of the second embodiment are the same as those of the first embodiment, and have the same functions and configurations.

Figure 3:
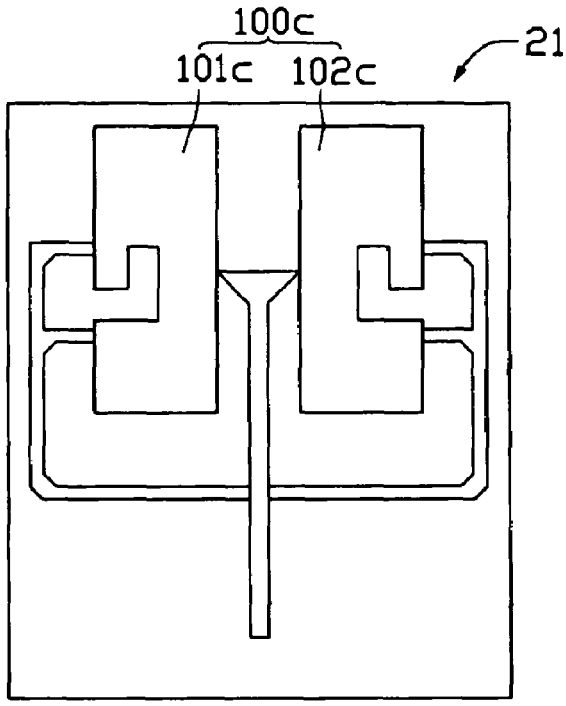
FIG. 3 is a top plan view of a UWB printed antenna in accordance with a third preferred embodiment of the present invention.

FIG. 3 is a top plan view of a UWB printed antenna 21 in accordance with a third preferred embodiment of the present invention. In the third embodiment, a body 100*c* includes a first radiating end 101*c* and a second radiating end 102*c*. The radiating ends 101*c* and 102*c* are rectangular-shaped. Advantageously, each of the radiating ends 101*c* and 102*c* has an "L" shaped gap therein. The radiating ends 101*c* and 102*c* are oriented symmetrically opposite each other. Other elements of the third embodiment are same as those of the first embodiment, and have the same functions and configurations.

Figure 4:
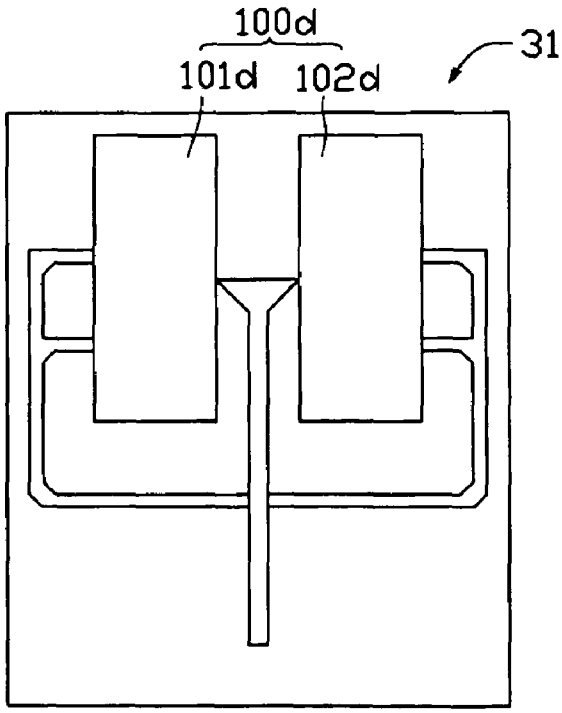
FIG. 4 is a top plan view of a UWB printed antenna in accordance with a fourth preferred embodiment of the present invention.

FIG. 4 is a top plan view of a UWB printed antenna 31 in accordance with a fourth preferred embodiment of the present invention. In the fourth embodiment, a body 100*d* includes a first radiating end 101*d* and a second radiating end 102*d*. The radiating ends 101*d* and 102*d* are rectangular-shaped, and are oriented parallel to each other. Other elements of the fourth embodiment are the same as those of the first embodiment, and have the same functions and configurations.

Figure 5:
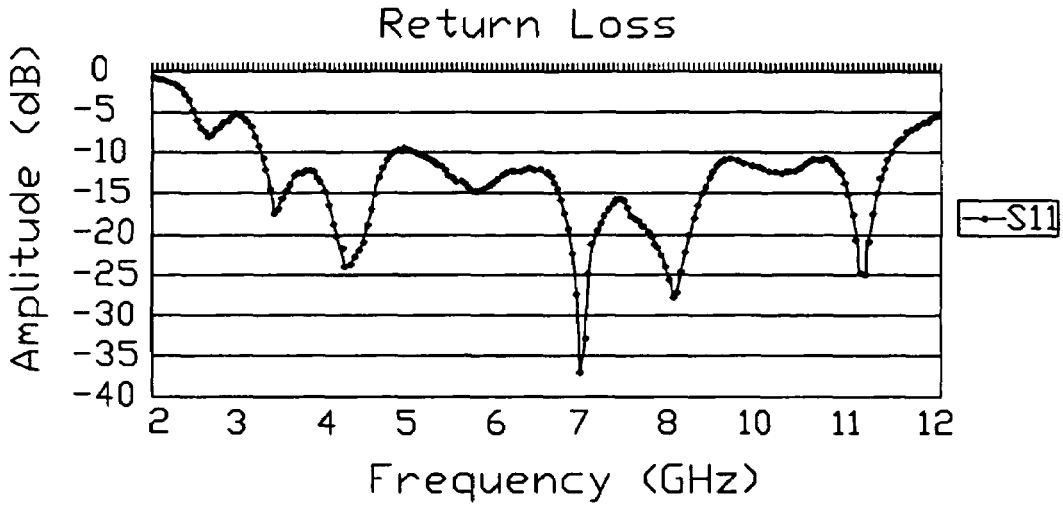
FIG. 5 is a graph showing return loss of the UWB printed antenna of any of the first through fourth embodiments.
Figure 6:
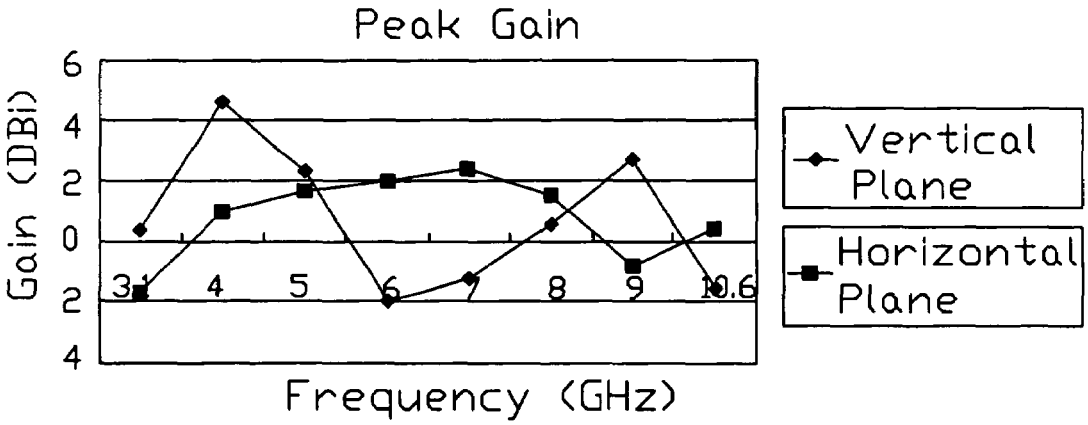
FIG. 6 is a graph showing peak gain of the UWB printed antenna of any of the first through fourth embodiments.
Figure 7:
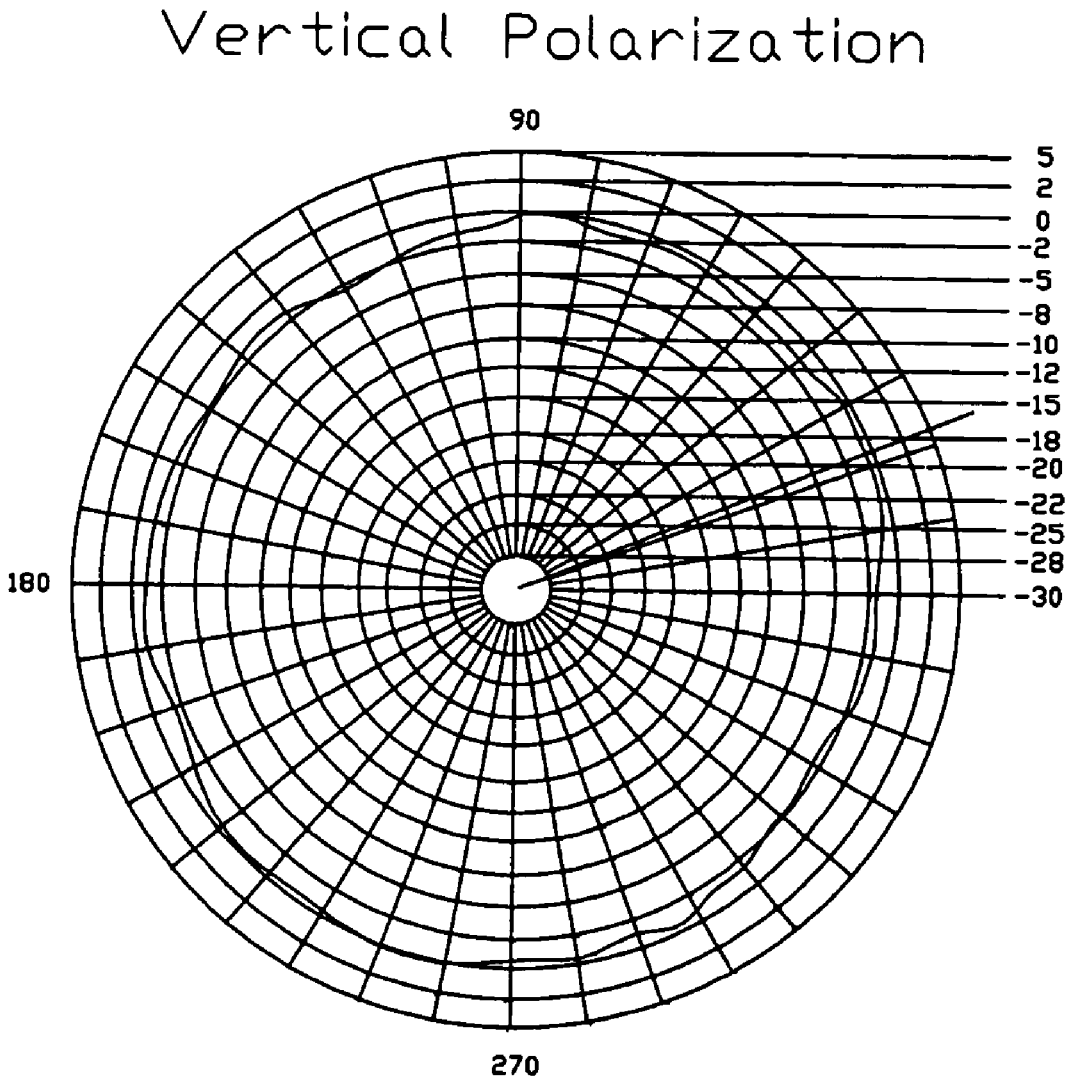
FIG. 7 is a test chart showing a measured vertical polarization pattern when the UWB printed antenna of any of the first through fourth embodiments is operated at a frequency of 3.1 GHz.
Figure 8:
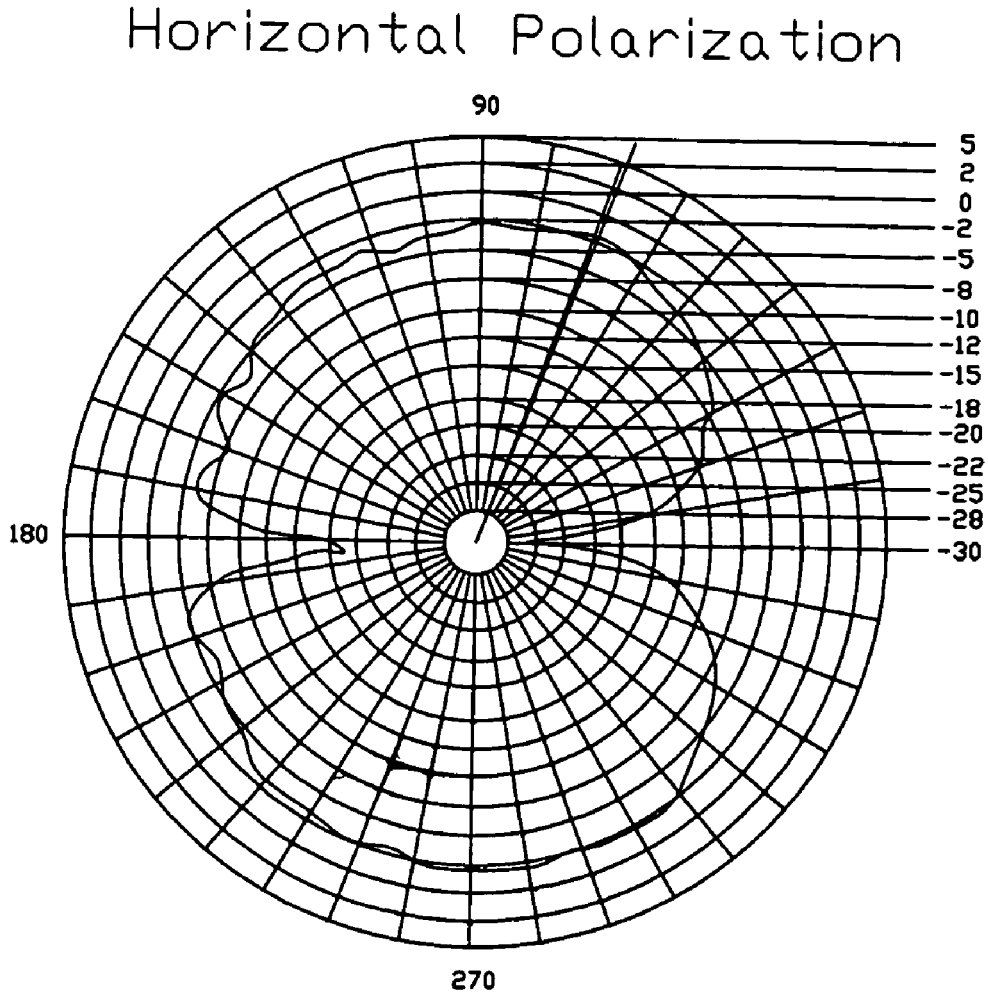
FIG. 8 is a test chart showing a measured horizontal polarization pattern when the UWB printed antenna of any of the first through fourth embodiments is operated at the frequency of 3.1 GHz.
Figure 9:
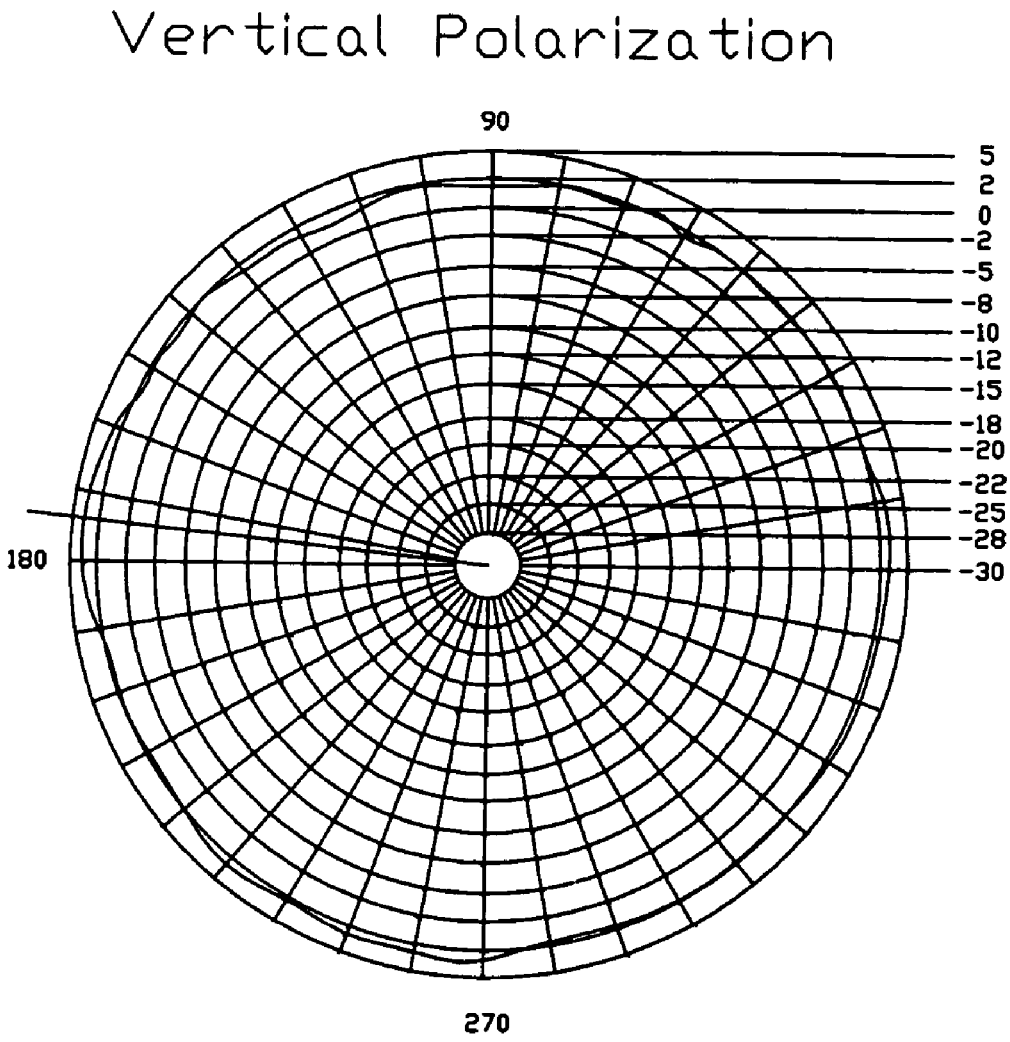
FIG. 9 is a test chart showing a measured vertical polarization pattern when the UWB printed antenna of any of the first through fourth embodiments is operated at a frequency of 4.0 GHz.
Figure 10:
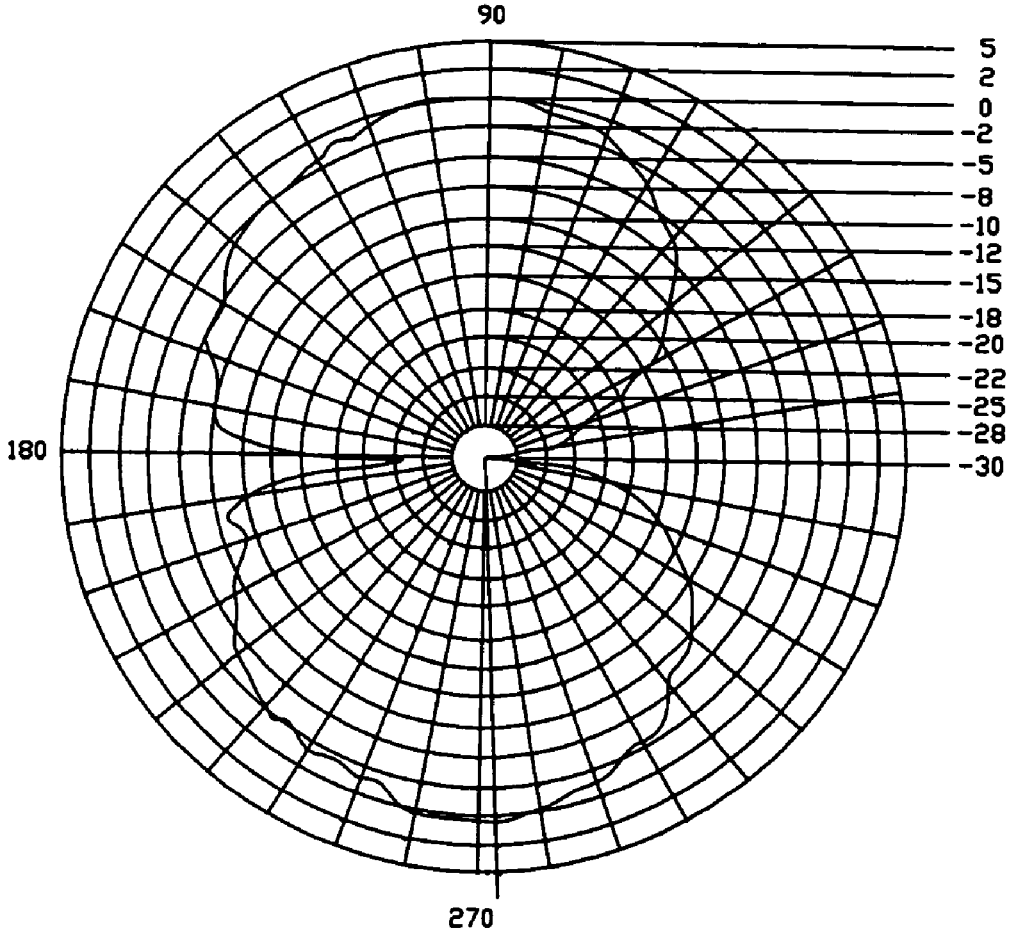
FIG. 10 is a test chart showing a measured horizontal polarization pattern when the UWB printed antenna of any of the first through fourth embodiments is operated at the frequency of 4.0 GHz.
Figure 11:
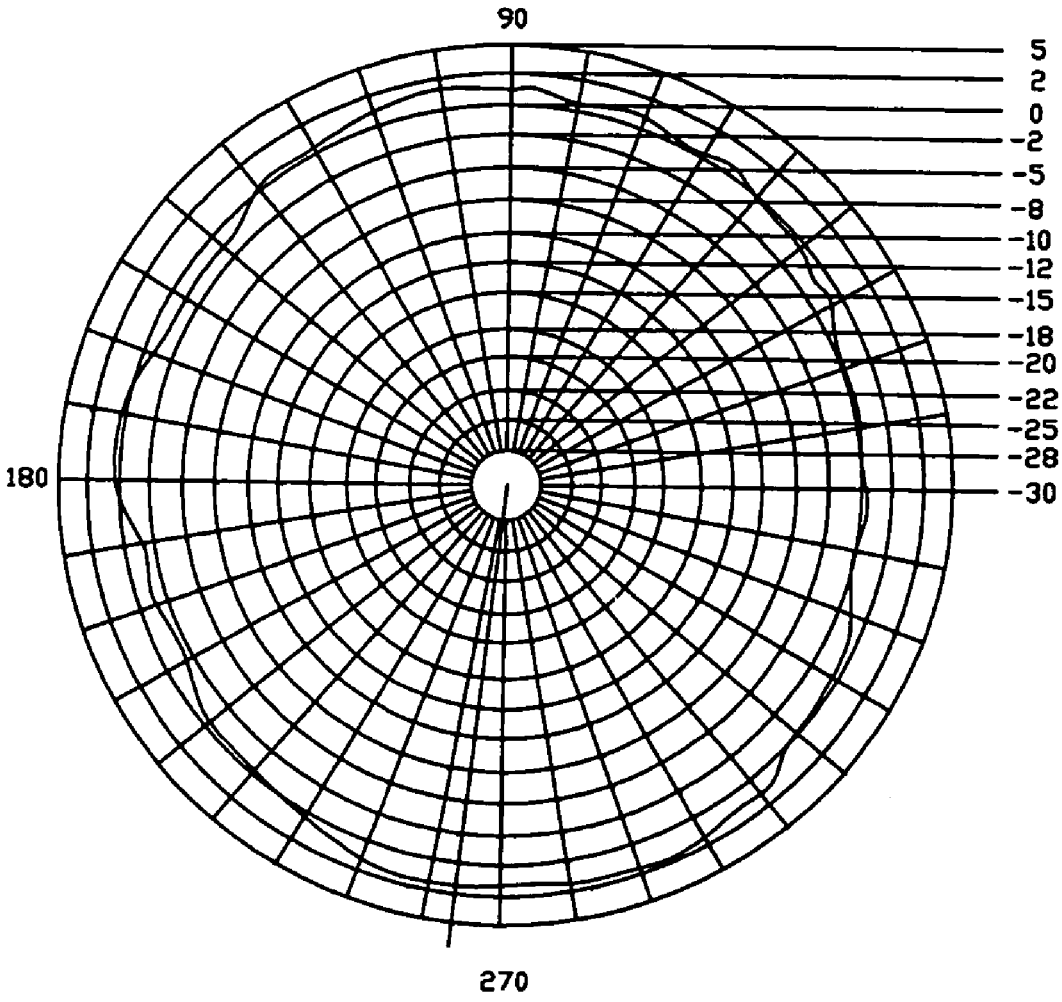
FIG. 11 is a test chart showing a measured vertical polarization pattern when the UWB printed antenna of any of the first through fourth embodiments is operated at a frequency of 5.0 GHz.
Figure 12:
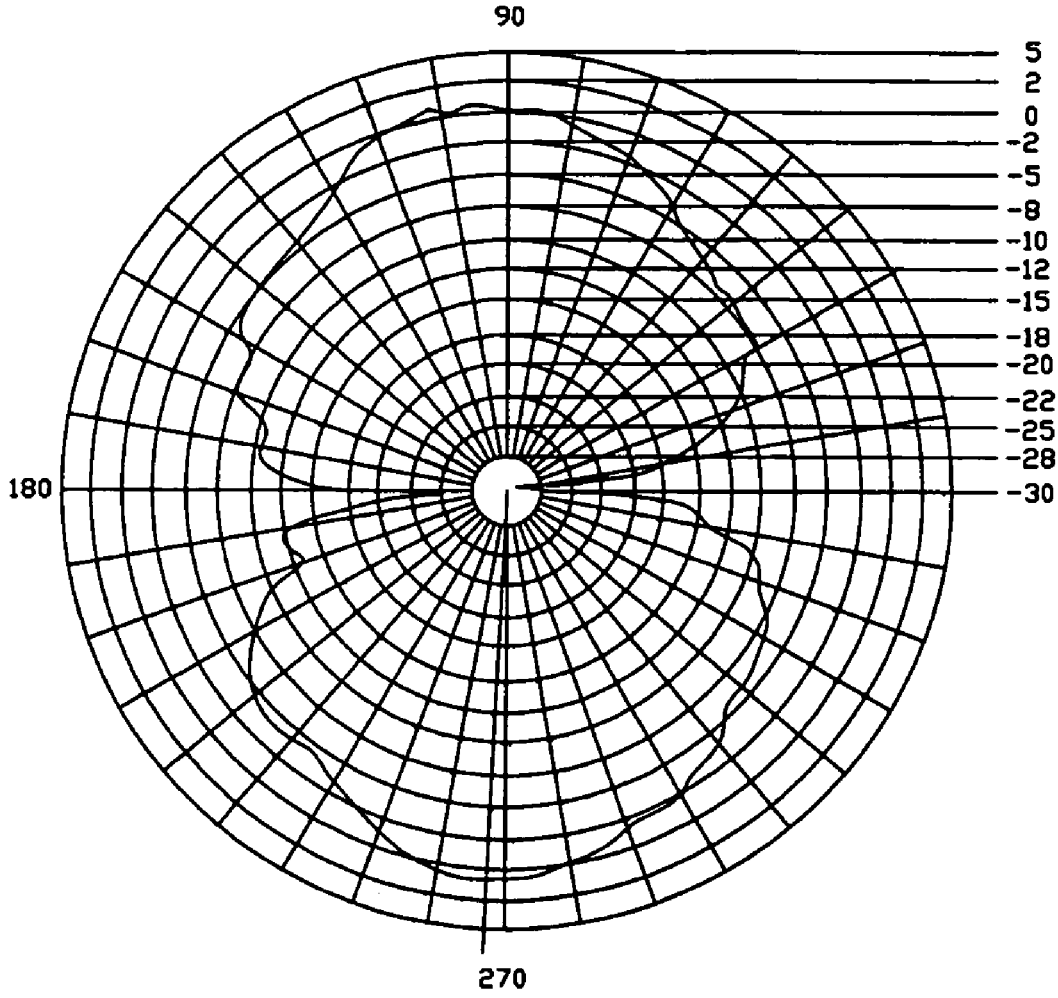
FIG. 12 is a test chart showing a measured horizontal polarization pattern when the UWB printed antenna of any of the first through fourth embodiments is operated at the frequency of 5.0 GHz.
Figure 13:
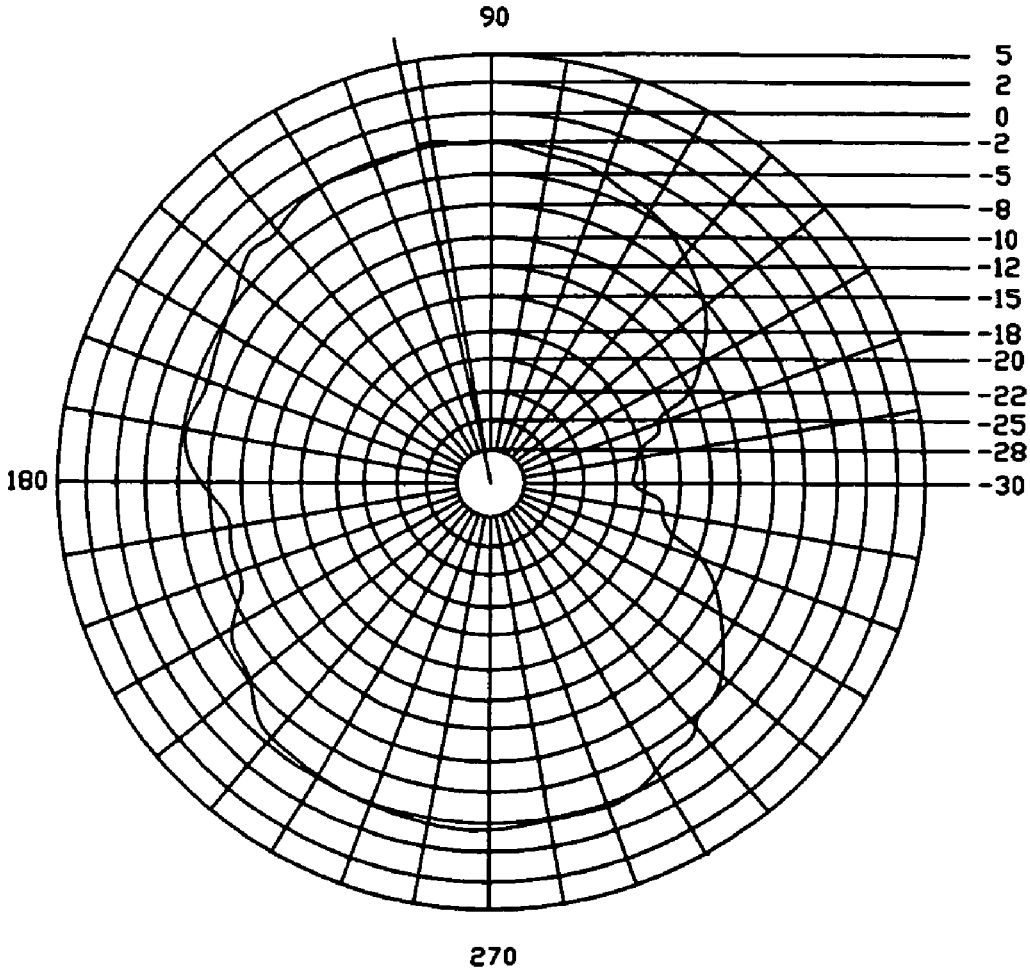
FIG. 13 is a test chart showing a measured vertical polarization pattern when the UWB printed antenna of any of the first through fourth embodiments is operated at a frequency of 6.0 GHz.
Figure 14:
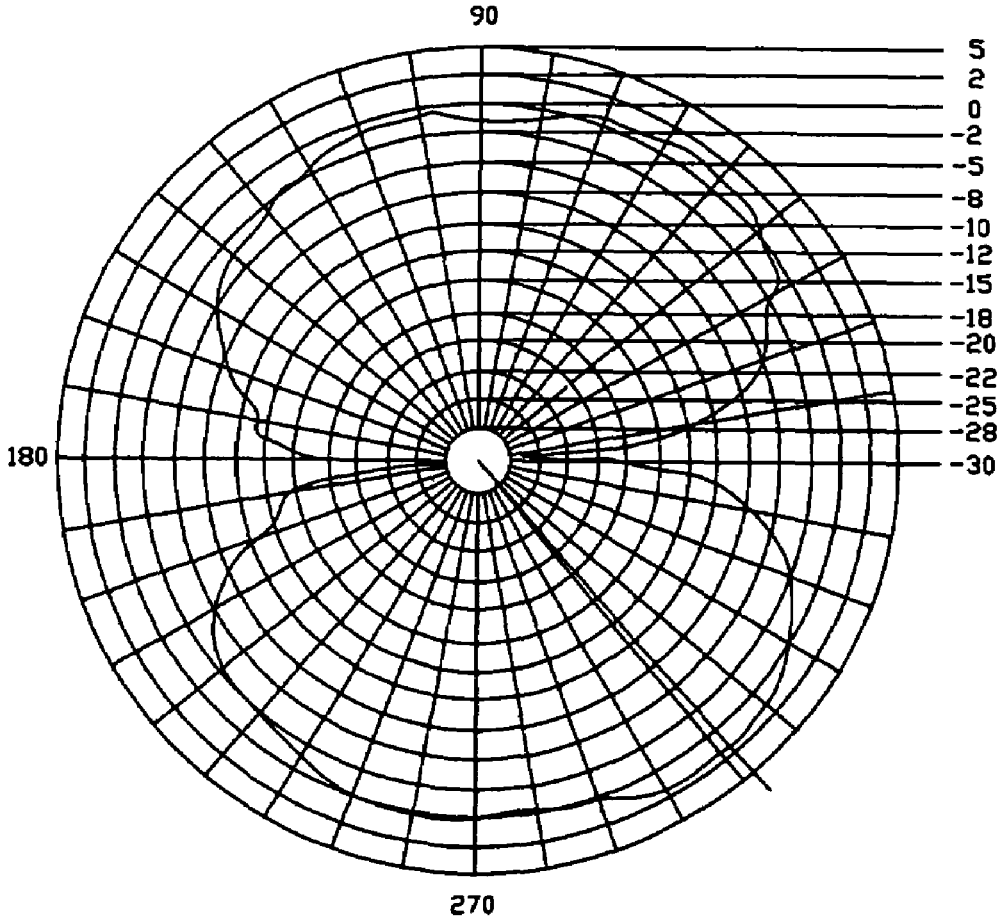
FIG. 14 is a test chart showing a measured horizontal polarization pattern when the UWB printed antenna of any of the first through fourth embodiments is operated at the frequency of 6.0 GHz.
Figure 15:
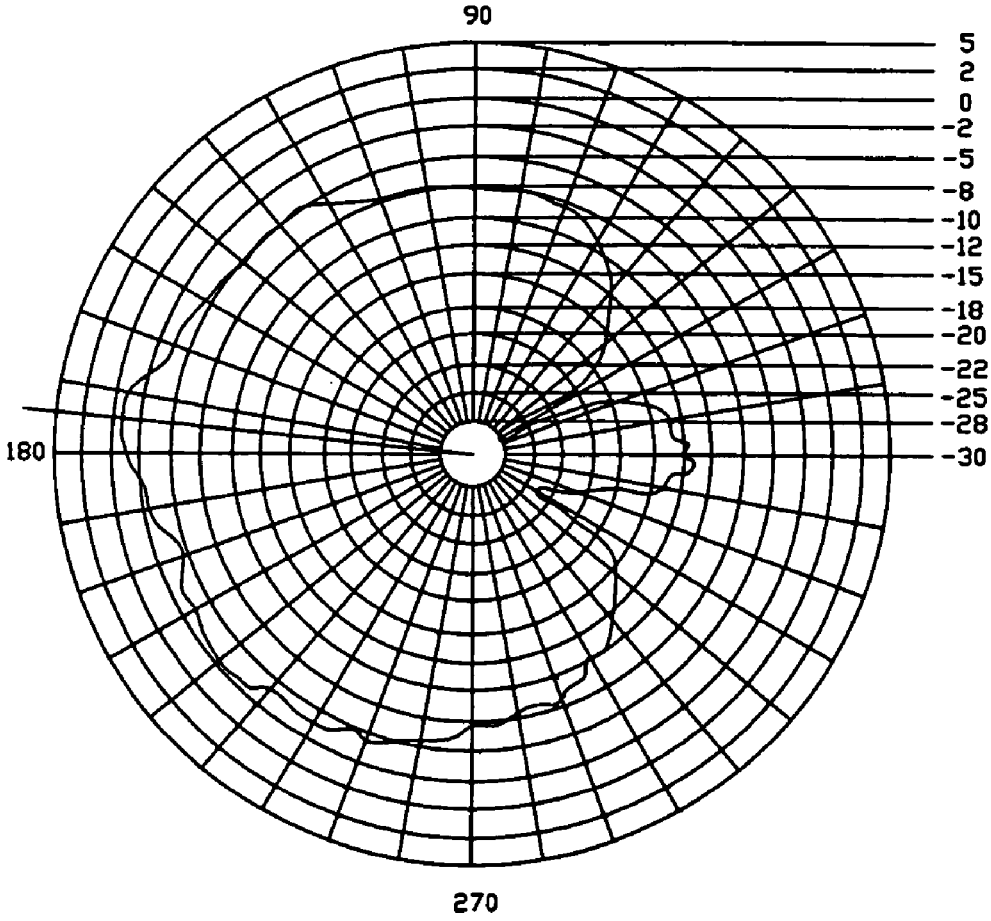
FIG. 15 is a test chart showing a measured vertical polarization pattern when the UWB printed antenna of any of the first through fourth embodiments is operated at a frequency of 7.0 GHz.
Figure 16:
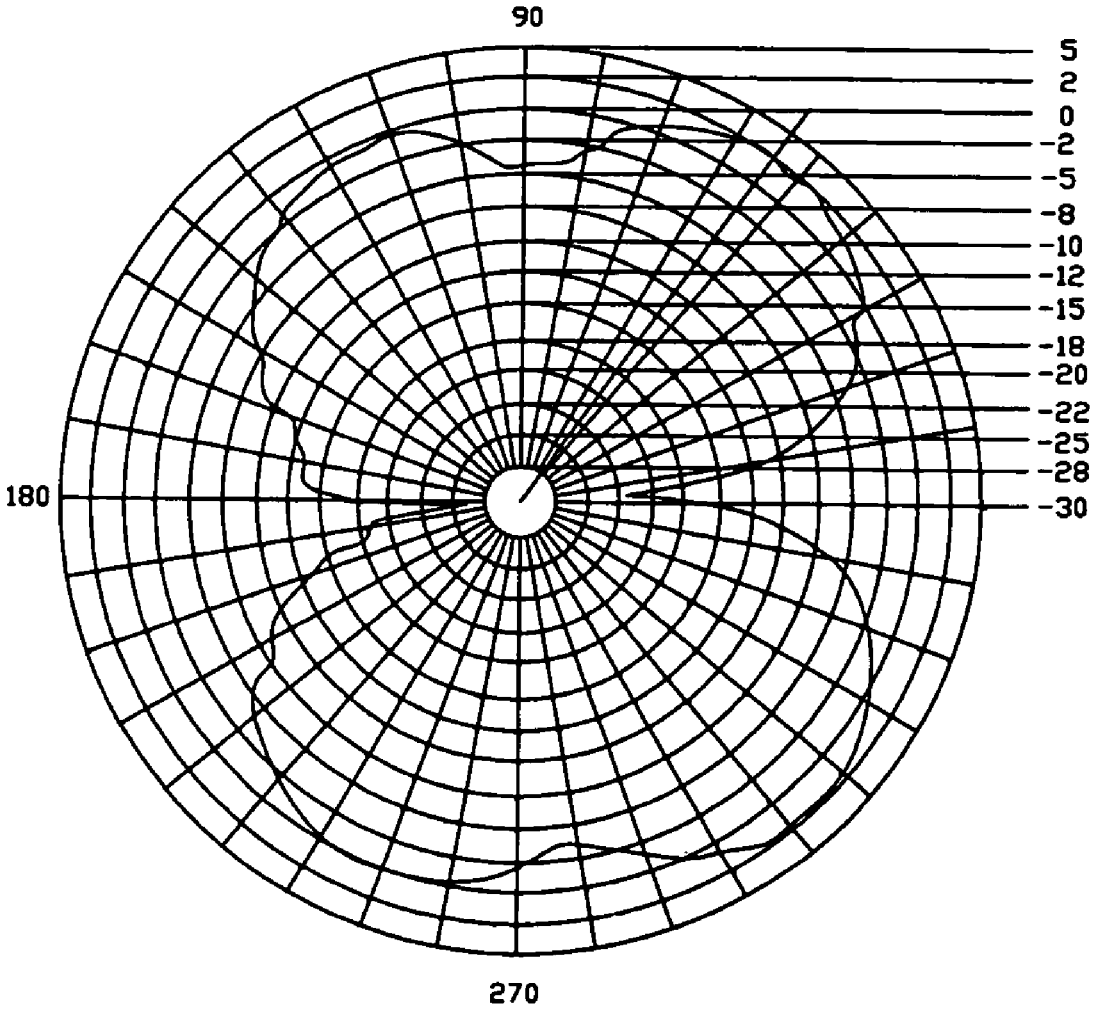
FIG. 16 is a test chart showing a measured horizontal polarization pattern when the UWB printed antenna of any of the first through fourth embodiments is operated at the frequency of 7.0 GHz.
Figure 17:
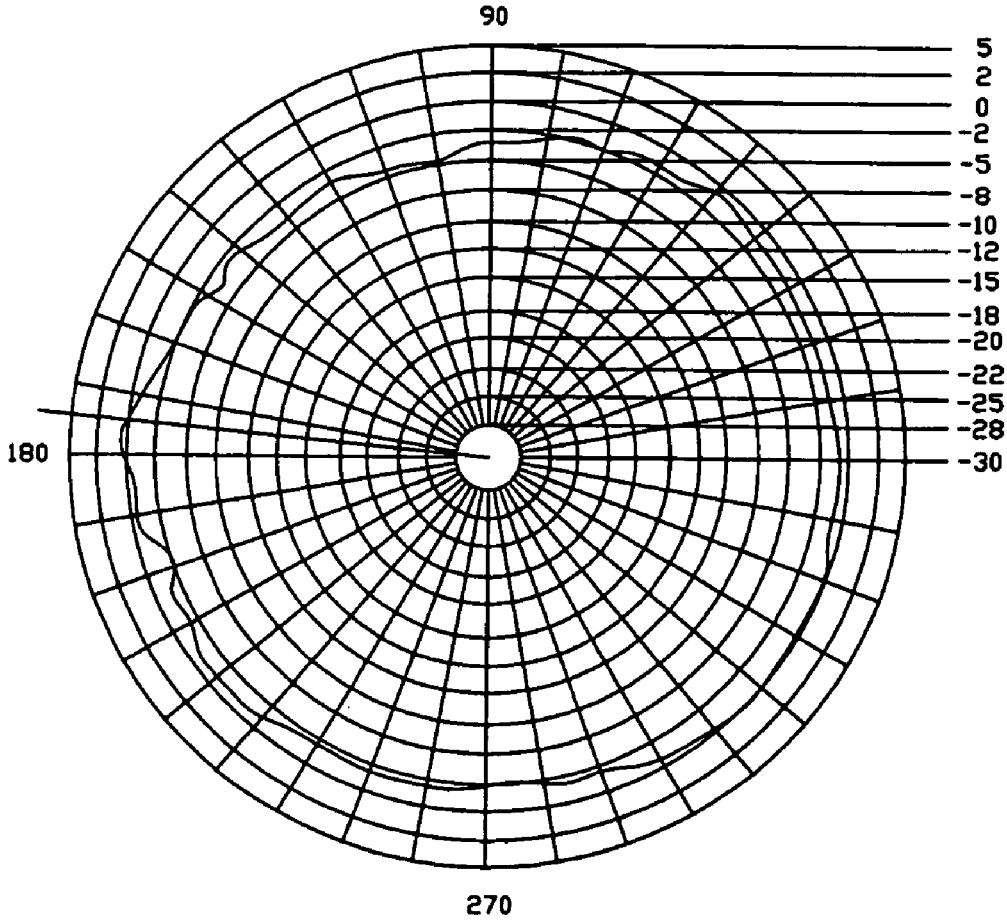
FIG. 17 is a test chart showing a measured vertical polarization pattern when the UWB printed antenna of any of the first through fourth embodiments is operated at a frequency of 8.0 GHz.
Figure 18:
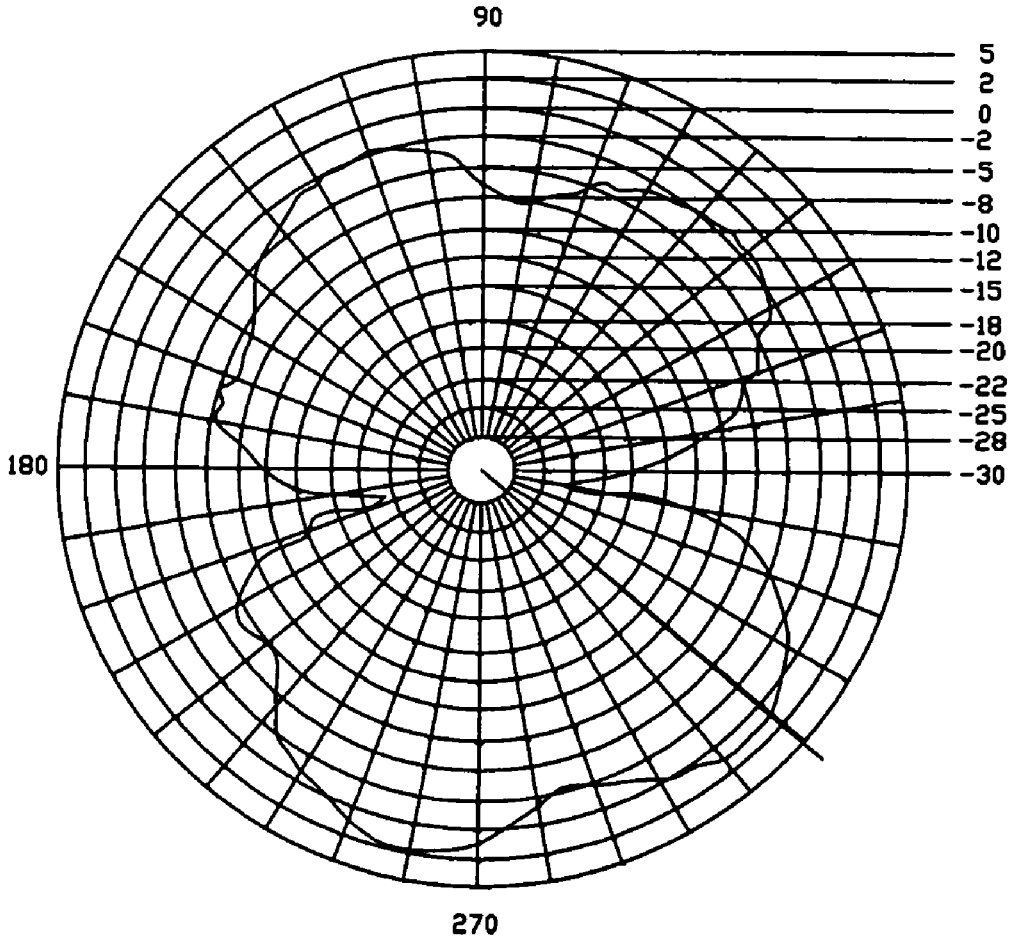
FIG. 18 is a test chart showing a measured horizontal polarization pattern when the UWB printed antenna of any of the first through fourth embodiments is operated at the frequency of 8.0 GHz.
Figure 19:
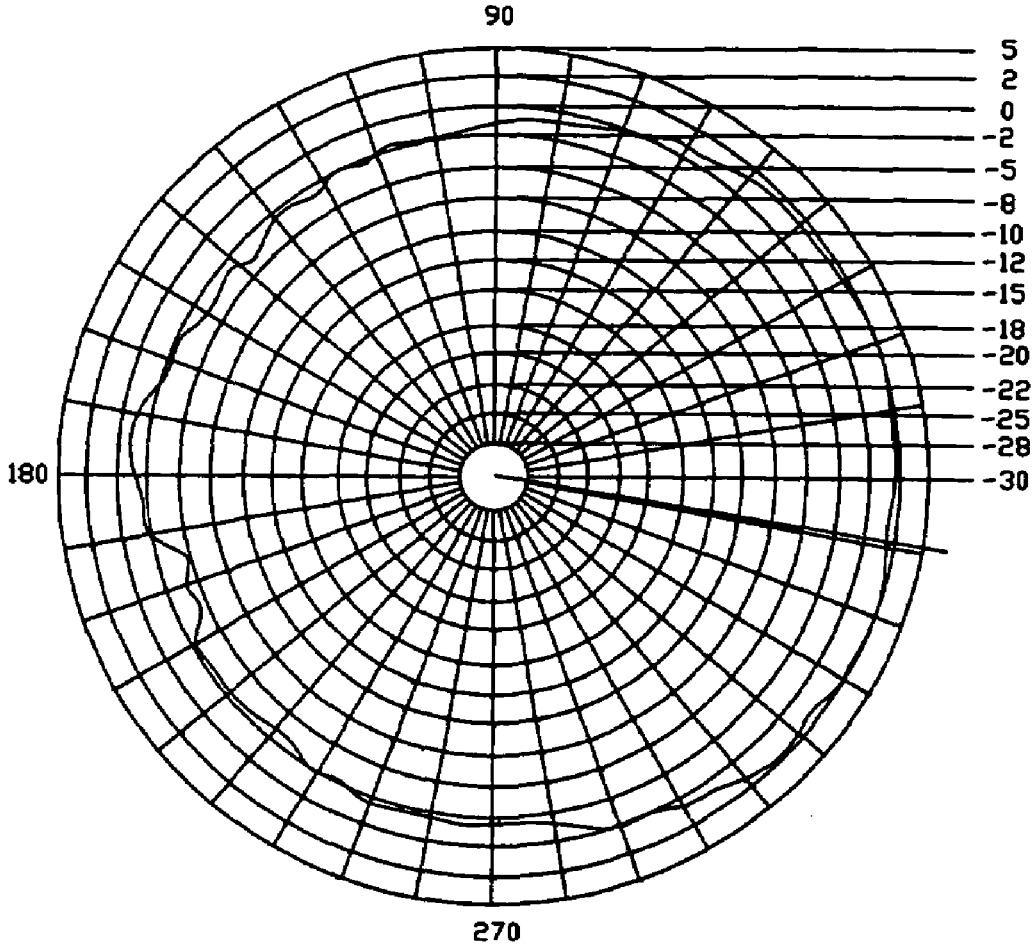
FIG. 19 is a test chart showing a measured vertical polarization pattern when the UWB printed antenna of any of the first through fourth embodiments is operated at a frequency of 9.0 GHz.
Figure 20:
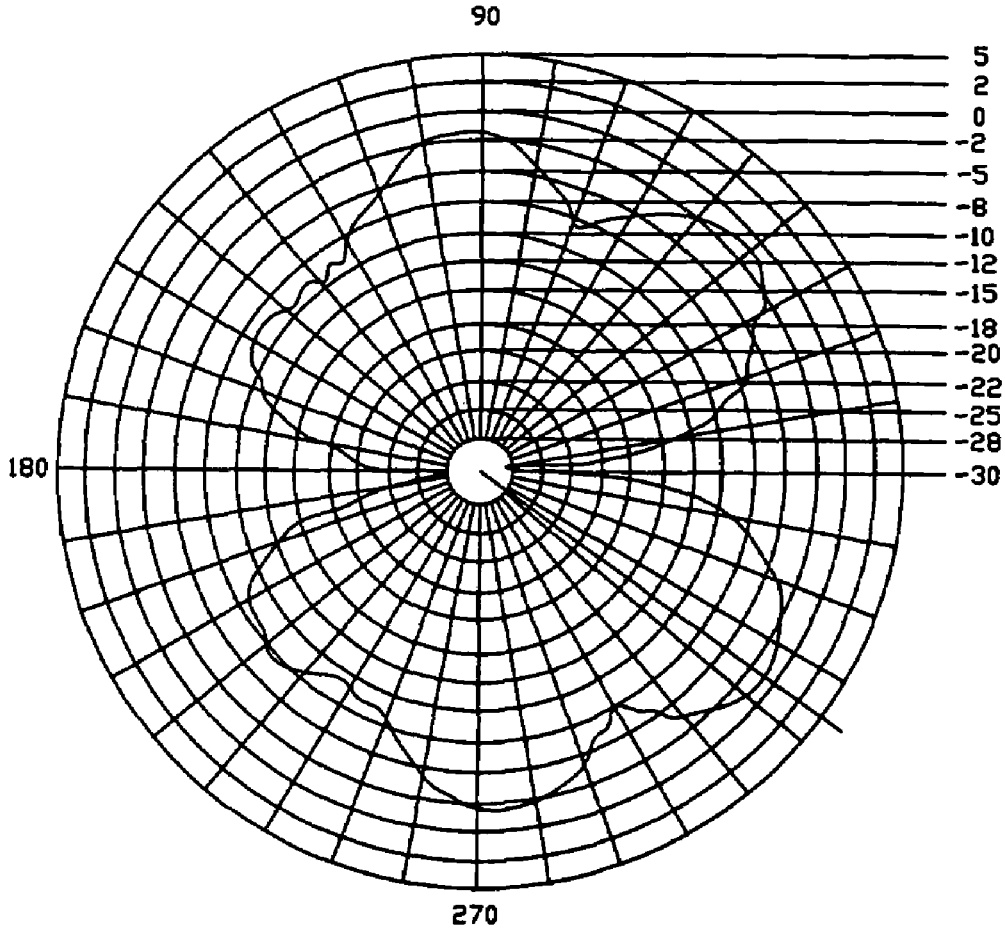
FIG. 20 is a test chart showing a measured horizontal polarization pattern when the UWB printed antenna of any of the first through fourth embodiments is operated at the frequency of 9.0 GHz.
Figure 21:
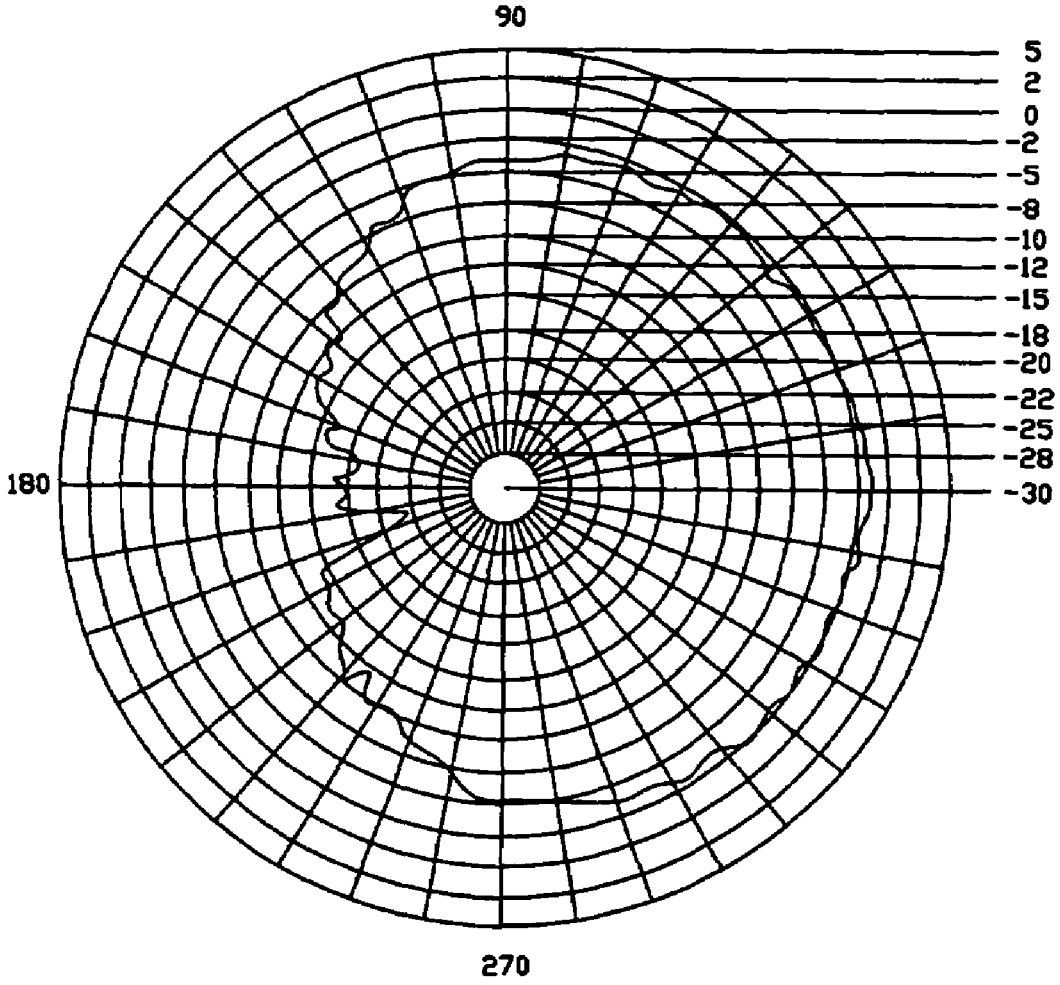
FIG. 21 is a test chart showing a measured vertical polarization pattern when the UWB printed antenna of any of the first through fourth embodiments is operated at a frequency of 10.6 GHz.
Figure 22:
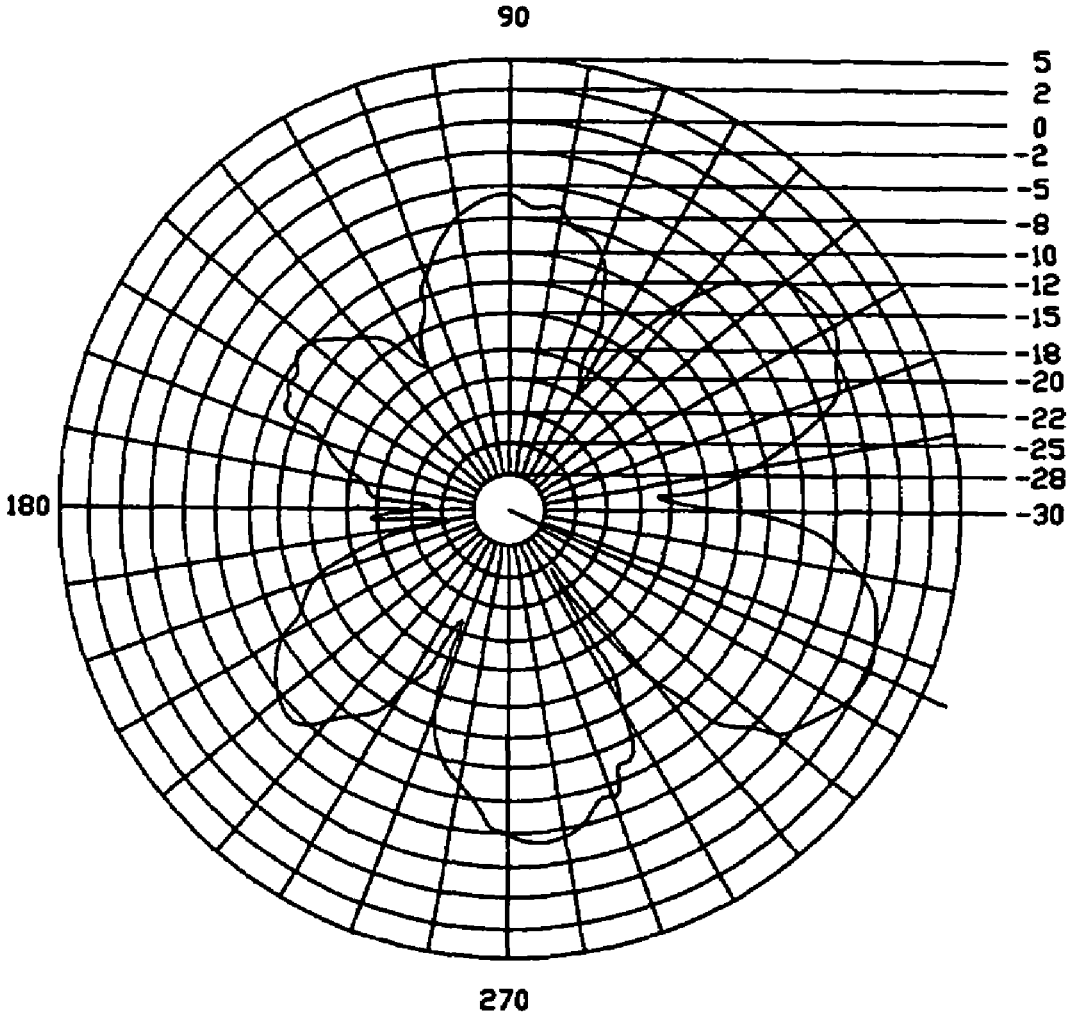
FIG. 22 is a test chart showing a measured horizontal polarization pattern when the UWB printed antenna of any of the first through fourth embodiments is operated at the frequency of 10.6 GHz.

FIG. 5 is a graph showing return loss of any of the UWB printed antennas 1, 11, 21, 31 of the first through fourth embodiments. When the UWB printed antenna 1, 11, 21, 31 operates in frequency bands of 3.1 GHz~10.6 GHz, return loss drops below −10 dB. FIG. 6 is a graph showing peak gain of any of the UWB printed antennas 1, 11, 21, 31. It is to be noted that the peak gain of the UWB printed antenna 1, 11, 21, 31 is suitable for the IEEE 802.15.3*a* standard.

FIG. 7 through FIG. 22 are graphs showing measured polarization patterns in a horizontal and a vertical plane when any of the UWB printed antennas 1, 11, 21, 31 is operated at frequencies of 3.1 GHz, 4.0 GHz, 5.0 GHz, 6.0 GHz, 7.0 GHz, 8.0 GHz, 9.0 GHz and 10.6 GHz respectively. It is to be noted that the average gain of the UWB printed antenna 1, 11, 21, 31 in a horizontal and a vertical plane is suitable for the IEEE 802.15.3*a* standard.

It is believed that the principles of the present invention have been realized through the embodiments disclosed herein. Those skilled in the art will appreciate that various aspects of the invention may be achieved through different embodiments without departing from the essential spirit and function of the invention. The particular embodiments are illustrative only, and are not intended to limit the scope of the invention as set forth in the following claims.

We claim:

1. An ultra wide band (UWB) printed antenna comprising:

a body for radiating and receiving electromagnetic signals, comprising a first radiating end and a second radiating end;

a signal feeding part for inputting electromagnetic signals to or outputting electromagnetic signals from the body;

a first feeding part, electronically connecting to the signal feeding part and the first radiating end, for feeding electromagnetic signals to the first radiating end;

a second feeding part, electronically connecting to the signal feeding part and the second radiating end, for feeding electromagnetic signals to the second radiating end; and a third feeding part, located between the first radiating end and the second radiating end, and electronically connecting to the signal feeding part, the first radiating end, and the second radiating end respectively.

2. The UWB printed antenna as recited in claim 1, wherein the first feeding part comprises a first body part, a first feeding end, and a second feeding end.

3. The UWB printed antenna as recited in claim 2, wherein the first feeding end and the second feeding end electronically connect the first body part to the first radiating end.

4. The UWB printed antenna as recited in claim 2, wherein the first body part, the first feeding end and the second feeding end of the first feeding part collectively form an "F " shape.

5. The UWB printed antenna as recited in claim 1, wherein the second feeding part comprises a second body part, a third feeding end, and a fourth feeding end.

6. The UWB printed antenna as recited in claim 5, wherein the third feeding end and the fourth feeding end electronically connect the second body part to the second radiating end.

7. The UWB printed antenna as recited in claim 5, wherein the second body part, the third feeding end and the fourth feeding end of the second feeding part collectively form an inverted "F " shape.

8. The UWB printed antenna as recited in claim 1, wherein the third feeding part, the first radiating end and the second radiating end collectively form an "H " shape.

9. The UWB printed antenna as recited in claim 1, wherein the first radiating end defines an "L " shaped gap.

10. The UWB printed antenna as recited in claim 1, wherein the second radiating end defines an "L " shaped gap.

11. The UWB printed antenna as recited in claim 1, wherein the first radiating end and the second radiating end are symmetrical along a preset line of the body, and the third feeding part is installed along the preset line of the body.

12. An antenna comprising:

a body for radiating and receiving electromagnetic signals;

a signal feeding part spaced from said body and electrically connectable with a processing unit for processing said electromagnetic signals, said signal feeding part capable of providing a signal-communicable accessible path between said body and said processing unit;

a first feeding part electrically connectable between said signal feeding part and a first side of said body so as to transmit said signals therebetween;

a second feeding part electrically connectable between said signal feeding part and a second side of said body different from said first side so as to transmit said signals therebetween; and another body symmetrically formed beside said body along said first side of said body so as to have said first feeding part located and electrically connectable between said body and said another body.

13. The antenna as recited in claim 12, further comprising a third feeding part electrically connectable between said signal feeding part and said second side of said body beside said second feeding part so as to transmit said signals therebetween.

14. The antenna as recited in claim 12, further comprising an L-shaped gap formed in said body from said second side thereof neighboring said second feeding part.

15. An antenna comprising:

a body for radiating and receiving electromagnetic signals, said body comprising a first end and a second end symmetrically formed along a preset line thereof;

a signal feeding part spaced from said body for signal communication with said body so as to transmit said electromagnetic signals for further processing;

a first feeding part installable along said preset line of said body and electrically connectable between said signal feeding part and said body so as to transmit said signals therebetween, and located and electrically connectable between the first end and the second end; and at least one second feeding part electrically connectable between said signal feeding part and said body along a side of said body located other than said preset line of said body so as to transmit said signals therebetween.

16. The antenna as recited in claim 15, further comprising an L-shaped gap formed in said body from said side of said body located other than said preset line of said body neighboring said at least one second feeding part.

* * * * *